US006702511B2

(12) United States Patent
Russell

(10) Patent No.: US 6,702,511 B2
(45) Date of Patent: Mar. 9, 2004

(54) CRASH GUARD WITH MONITORING

(76) Inventor: Rockford Roy Russell, Rte. 1 Box 255 AA, Davis, OK (US) 73030

( * ) Notice: Subject to any disclaimer, the term of this patent is extended or adjusted under 35 U.S.C. 154(b) by 0 days.

(21) Appl. No.: 10/046,646

(22) Filed: Jan. 16, 2002

(65) Prior Publication Data

US 2003/0133749 A1 Jul. 17, 2003

(51) Int. Cl.[7] ..... E01F 15/00
(52) U.S. Cl. ..... 404/6; 404/10
(58) Field of Search ..... 404/6, 9, 10; 256/13.1; 118/371

(56) References Cited

U.S. PATENT DOCUMENTS

| | | | | | |
|---|---|---|---|---|---|
| 2,974,934 | A | * | 3/1961 | White | 256/13.1 |
| 3,385,564 | A | * | 5/1968 | Persicke | 256/13.1 |
| 3,436,057 | A | * | 4/1969 | Mazelsky | 256/13.1 |
| 3,672,657 | A | * | 6/1972 | Young et al. | 267/116 |
| 3,690,619 | A | * | 9/1972 | Kendall | 256/13.1 |
| 4,047,701 | A | * | 9/1977 | Glaesener | 256/13.1 |
| 4,662,611 | A | * | 5/1987 | Ruane | 256/13.1 |
| 4,674,911 | A | | 6/1987 | Gertz | |
| 4,688,766 | A | | 8/1987 | Zucker | |
| 4,934,661 | A | | 6/1990 | Denman et al. | |
| 4,973,190 | A | | 11/1990 | Erwin et al. | |
| 4,974,820 | A | * | 12/1990 | Nakanishi | 267/152 |
| 5,403,113 | A | | 4/1995 | Gertz et al. | |
| 5,823,705 | A | | 10/1998 | Jackson et al. | |
| 5,957,616 | A | | 9/1999 | Fitch | |
| 2002/0141818 | A1 | * | 10/2002 | Moore | 404/6 |

* cited by examiner

*Primary Examiner*—Gary S. Hartmann

(57) ABSTRACT

A reusable energy absorbing device constructed of an air bag, with one or more air chambers, in front of an obstruction (e.g., a concrete wall). The air bag has a release valve in each air chamber to release the trapped air at extreme pressure within and at a controlled rate. The air bag having a mechanical and/or electronic device to indicate the air bags internal air pressure. The electronic devices to be used to check air pressure level and monitor for a crash. The air bag is protected by a metal strike plate that is hinged on one edge. The hinge is anchored to the existing obstruction. The metal strike plate is held in place over the air bag by one or more restraints (e.g., cable) opposite the hinged edge. The restraints are to prevent the metal strike plate from swinging into the line of traffic after an impact. The metal strike plate is to point away from the on coming traffic. The metal strike plate is set between 5 degrees and 60 degrees to the obstruction and the roadway. The reusable energy absorbing device can be installed in an array of multiple units along the obstruction parallel to the roadway.

5 Claims, 2 Drawing Sheets

CRASH GUARD WITH MONITORING

BACKGROUND

The need to reduce the impact of a vehicle coming in contact with obstructions (i.e., concrete walls), is needed to help save lives of the occupants. The steeper the angle of impact the greater the chance of sever injury to the occupant in the past other inventors have tried to resolve this problem, but all have fell short of the mark. Inventors have used all sorts of very complicated devices that are hard or expensive to make and install. Some require special walls or structures to be built. Some devices would require lengthy clean up time and man power after a crash.

This invention can retrofit obstructions by the use of an air bag sandwiched against the barrier. Over the air bag is a metal strike plate to prevent the vehicle from tearing the air bag and to spread the weight of the impact over the surface of the air bag. The metal plate is hinged on one edged and the hinge is anchored to the obstruction. On the opposite side from the hinge the metal plate is held by one or more restraints (e.g., cables). The metal plate is set at an angle to the obstruction and the roadway from 5 degrees to 60 degrees. Installed on the obstruction is a series of the invention devices that over lap each other. The angle of the metal plates points away from the on coming traffic. When the plate is struck by a vehicle, the air in the bag or bags struck begin to build in pressure. At a critical point a valve opens and lets the air escape at a controlled rate. The auto is slowed in the process and the occupants have a greater chance of escaping serious injures. The air bag is then either replaced, or refilled with air. The strike plate is either replaced, or is put back into place and secured by the restraints. The air bag has a mechanical indicator to show the air pressure inside, and/or an electronic element connected to a control point. The control point monitor can tell when there is a crash by the rise in the air pressure. The monitor can then send appropriate personnel to the crash site.

During a race, such as a NASCAR event, the cars sometimes brush the wall. When this happens the car is only slightly damaged. When the race car hits the wall hard, on any of it six sides (top-bottom-right-left-front-back), the driver is often injured. When the race car wrecks in the turns the angle is often very much straight head-on. At any speed the driver is often injured. With this device installed the impact can be greatly reduced. There is no debris, or very little, scattered over the racing service from the device. Therefore no time is lost to cleaning up the racing serface. While the track crew members are removing the race car, the debris that it spread over the racing surface, another crew reinflates the deflated air bag, or replace it with a new one. They then reset the metal strike plate, or replace it with a new one. They then replace the restraints and check the air pressure and the electronic connections. A-O-K The race is resumed. This device is capable of being installed on the concrete walls that have injured or taken the lives of so many race drivers. No need to tear out walls and replace them with new ones with some built in elaborate mechanism. Two or more anchors are all that is needed to install the invented device.

SUMMARY OF THE INVENTION

This reusable device is for reducing the amount of impact a vehicle encounters when striking an unmoveable object. This device uses an air bag sandwiched between the unmovable object and a metal strike plate. The air bag may have one or more air chambers. Each chamber to have a valve to release the excessive air pressure that builds when a vehicle hits the strike plate. When the air is released it is at a controlled rate. A mechanical indicator shows the air pressure inside the chamber or chambers at a glimpse. Also and/or an electronic sensor is connected to a control point where the air pressure is monitored. When a vehicle hits the metal strike plate, the rise in pressure is alerted to the person monitoring the air bags. An other wise unnoticed accident can be brought to the attention of someone that can dispatch help to the scene. The metal strike plate is used to protect the air bag from being torn during a crash and to distribute the force of the impact over the entire surface of the air bag. This metal strike plate is held in place on one side by a hinged portion that is anchored to the unmovable object. The other side of the strike plate is held in check by one or more restraints (e.g., cables). The restraints hold the metal strike plate tight against the air bag. The restraints also keep the metal strike plate from swinging out into way of the on coming traffic. The metal strike plate is set to an angle between 5 degrees and 60 degrees to the roadway. The metal strike plate points away from the on coming flow of traffic.

DETAILED DESCRIPTION OF THE PREFERRED EMBODIMENT

Figure 1:
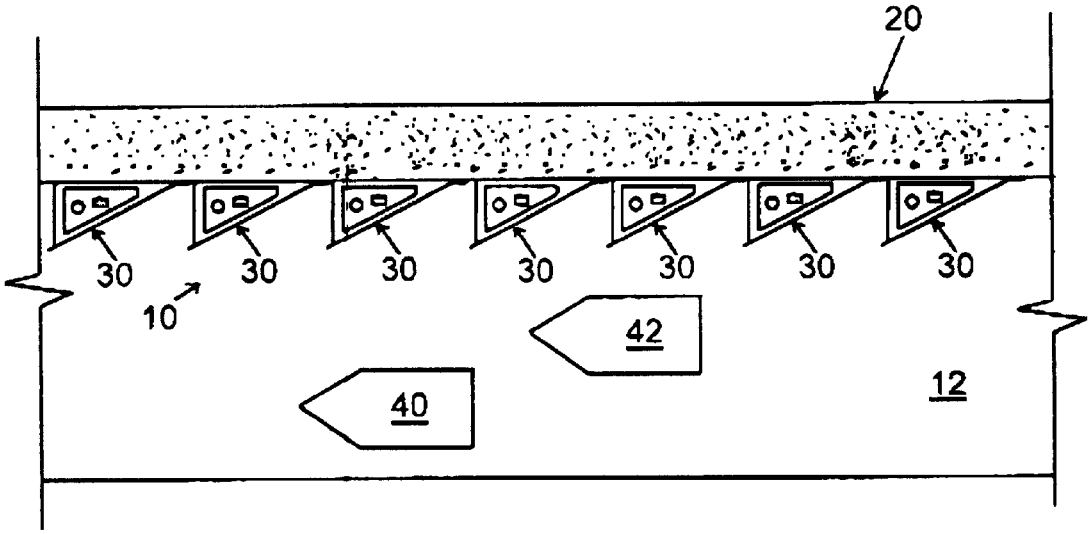
FIG. 1 illustrates a typical accurate portion of a racetrack with an embodiment of the present invention mounted on an obstruction.
Figure 2:
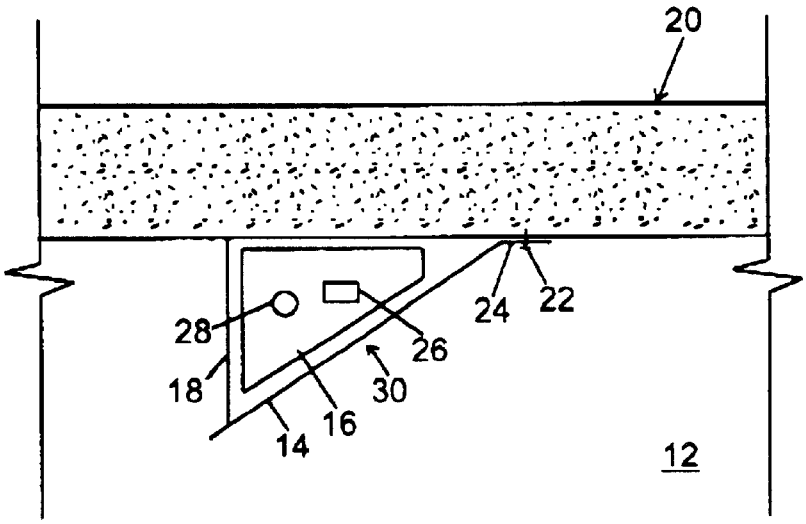
FIG. 2 demonstrates a top view of an embodiment of the present invention.
Figure 3:
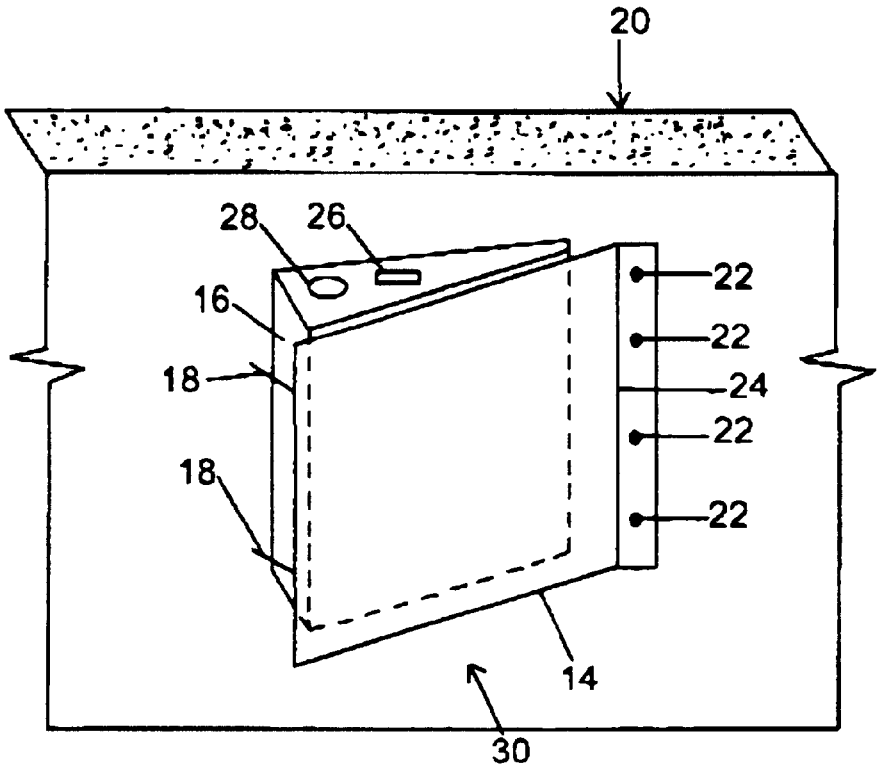
FIG. 3 shows a perspective view of an embodiment of the present invention.

Before explaining the present invention in detail, it is to be understood that the invention is not limited in its application to the details of the construction and arrangement of parts illustrated in the accompanying drawings. The invention is capable of other embodiments and of being practiced or carried out in a variety of ways. It is to be understood that the phraseology and terminology employed herein are for the purpose of description and not of limitation.

In one embodiment, the present invention comprises an impact absorbing apparatus 10 mourned to a stationary obstruction 20. The impact absorbing apparatus 10 is preferably used in conjunction with racetrack 12 having race cars 40–42 thereon. Impact absorbing apparatus 10 is joined to the inside of obstruction 20 which surrounds the outer perimeter of racetrack 12.

The impact absorbing apparatus 10 comprises a series of impact absorbing units 30 attached to the stationary obstruction 20. Each unit 30 includes a hinged strike plate 14 anchored to the obstruction 20 at an angle of between 5 and 60 degrees relative to a longitudinal direction of the obstruction 20. An air bag 16 is mounted between the strike plate 14 and the obstruction 20. The air bag 16 has at least one chamber and at least one pressure relief valve 28. Further, means 26 for indicating air pressure are located within the air bag 16.

In another embodiment, the present invention comprises an impact absorbing apparatus 10 as set out above wherein the means 26 for indicating air pressure is electronic.

In another embodiment, the present invention comprises an impact absorbing apparatus 10 as set out above wherein the means 26 for indicating air pressure is mechanical.

In another embodiment, the present invention comprises an impact absorbing apparatus 10 as set out above wherein the strike plate 14 is attached to the obstruction 20 by elongated restraints 18 at an edge of the strike plate 14 opposite the hinge 24.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. An impact absorbing apparatus mounted to a stationary obstruction, said impact absorbing apparatus comprising:

a hinged strike plate anchored to the obstruction at an angle of between 5 and 60 degrees relative to a longitudinal direction of the obstruction;

an air bag mounted between said strike plate and the obstruction;

said air bag having at least one chamber and at least one pressure relief valve; and means for indicating air pressure within said air bag.

2. The impact absorbing apparatus of claim 1, wherein the means for indicating air pressure is electronic.

3. The impact absorbing apparatus of claim 1, wherein the means for indicating air pressure is mechanical.

4. The impact absorbing apparatus of claim 1, wherein the strike plate is attached to the obstruction by elongated restraints at an edge of the strike plate opposite the hinge.

5. The impact absorbing apparatus of claim 1, wherein a plurality of said impact absorbing apparatus are mounted to said stationary obstruction.

* * * * *